United States Patent [19]

Schneller et al.

[11] B 3,984,269

[45] Oct. 5, 1976

[54] ACCELERATED DRYWALL JOINT TREATMENT

[75] Inventors: Joseph W. Schneller, Williamsville; Richard E. Smith, Tonawanda, both of N.Y.

[73] Assignee: National Gypsum Company, Buffalo, N.Y.

[22] Filed: Mar. 29, 1974

[21] Appl. No.: 456,148

[44] Published under the second Trial Voluntary Protest Program on January 13, 1976 as document No. B 456,148.

[52] U.S. Cl. ..... 156/71; 106/38.3; 106/110; 106/315; 156/44; 427/301; 427/403; 428/47; 428/52

[51] Int. Cl.[2] ..... E04B 2/72; E04B 2/00

[58] Field of Search ..... 117/169 R, 104 R, 622, 117/70 R, 70 D; 106/315, 109, 110, 38.3, 112; 156/71, 44, 45, 39; 428/47, 52

[56] References Cited

UNITED STATES PATENTS

| | | | |
|---|---|---|---|
| 3,035,940 | 5/1962 | Hobson | 117/169 R |
| 3,116,195 | 12/1963 | Lathrop et al. | 156/71 |
| 3,284,227 | 11/1966 | Gerton | 117/70 D |
| 3,383,271 | 5/1968 | Roberts et al. | 117/70 R |
| 3,576,091 | 4/1971 | Shull et al. | 156/71 |

*Primary Examiner*—Edward G. Whitby
*Attorney, Agent, or Firm*—Robert F. Hause

[57] ABSTRACT

In the application of a plurality of layers of a settable joint compound over a reinforcing tape, in drywall construction, a thin coat of $Al_2SO_4$ is sprayed over the tape and the board edges prior to applying the first layer and over the top of each layer immediately after the layer is applied.

1 Claim, 3 Drawing Figures

ACCELERATED DRYWALL JOINT TREATMENT

This invention relates to the acceleration of the set of a settable drywall joint compound and particularly to the use of a layer of set accelerator beneath and on top of each coat of settable compound, whereby the setting time can be reduced to about one-tenth the setting time without the accelerator.

In constructing homes at their permanent site, it was not a great problem if the mechanic had to wait a day in between two coats of a joint compound, so the first coat could set and harden first. In factory construction of homes, a delay between operations takes up factory floor space, delaying completion and shipment of homes, all at considerable additional cost. Methods which can avoid any delays in between successive steps in the process of factory building of homes can be of very significant value. If accelerator were added to the joint compound as it is mixed to make the set 10 times as fast, the amount of compound that could be prepared at one time would be only one-tenth the amount that could otherwise be prepared, or otherwise the compound would harden before it was all used. Ten times as many mixing operations would then be required.

The present invention contemplates the spray application of a thin coat of $Al_2SO_4$, or the equivalent, over a reinforcing joint tape and the surrounding board edge surfaces prior to the application of the first coat of a joint compound comprising a settable calcined gypsum binder, and then another thin coat over the first coat of the joint compound.

It is an object of the present invention to provide an improved method for accelerating the application of joint-concealing compounds over drywall joints.

It is a further object to provide such acceleration of the joint-concealing process without the inconvenience of many additional mixings of an accelerated-set joint compound.

These and other objects and advantages will be more readily apparent when considered in relation to the preferred embodiments as set forth in the specification and shown in the drawings in which.

Figure 1:
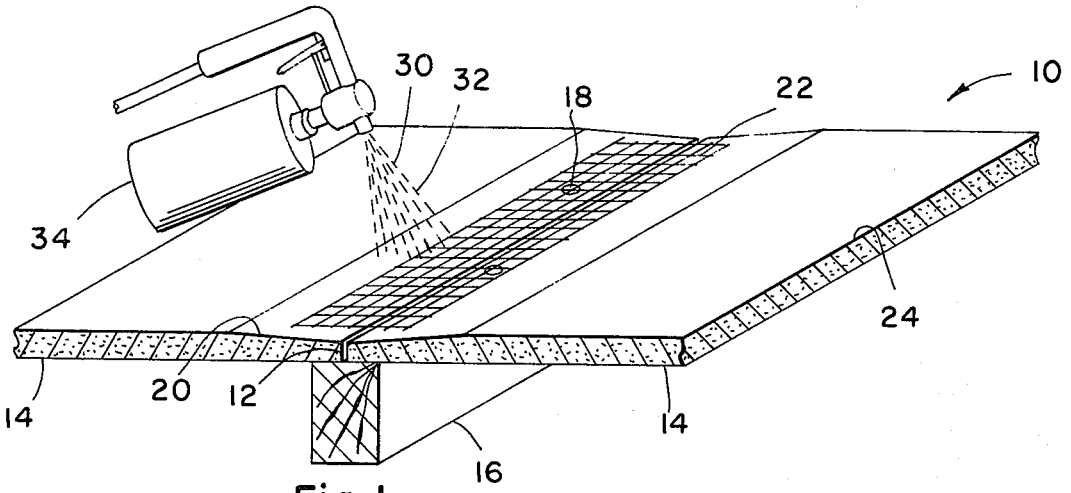
FIG. 1 is an isometric view of a taped drywall joint suitable for further processing in accordance with the invention.

Referring to FIG. 1, there is shown a section of wall 10, at a joint 12 between two adjacent gypsum wallboards 14, 14. The wallboards 14, 14 are fastened to a stud 16 by nails 18. Each wallboard 14 is formed with a taper 20 along the edge. The two adjacent tapers 20, 20 form a depressed zone along an area surrounding the joint 12. An open mesh woven fabric tape 22 is adhered over the joint 12. The tape 22 is of a width of about two inches, and a thickness of about 0.01 inch. The total width of the two areas of taper 20 combined is about five inches. Each taper 20 produces an edge thickness which is about 0.06 inch less than the thickness of the main portion 24 of wallboard 14.

The tape 22 is preferably one of the types which is applied and which then substantially immediately provides full reinforcing strength, such as the THERMO-WELD tape, of National Gypsum Company, which has a coating of hot-melt adhesive on the woven strands, or the QUIK-WELD tape, of National Gypsum Company, which has a pressure-sensitive adhesive on one face of the woven strands. The making of tapered edge gypsum wallboard joints covered with rapid bonding mesh tape as hereinabove described is well known in the art.

In accordance with the present invention, a thin coat of a set accelerator 30, such as aluminum sulphate, is applied as by spraying a solution 32 of aluminum sulphate with a spray gun 34, covering all of the tape 22 and substantially all of the area of the two tapers 20, 20.

Figure 2:
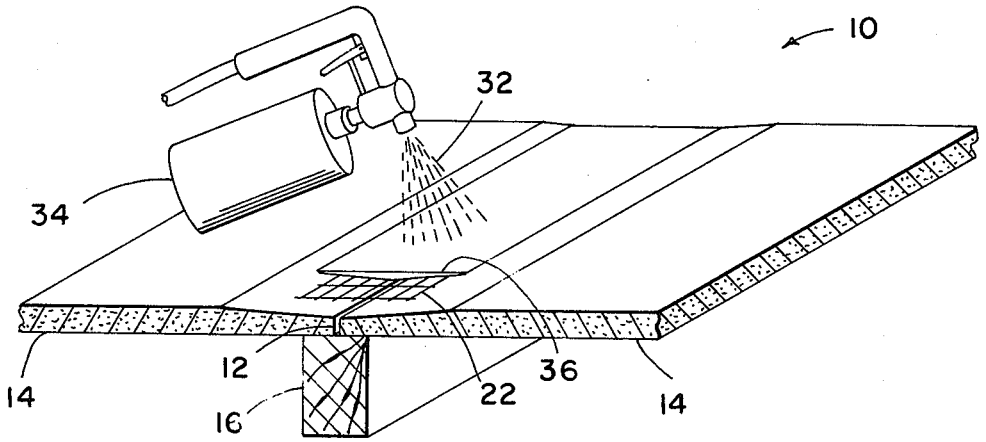
FIG. 2 is a view similar to FIG. 1, showing a first coat of joint compound applied.
Figure 3:
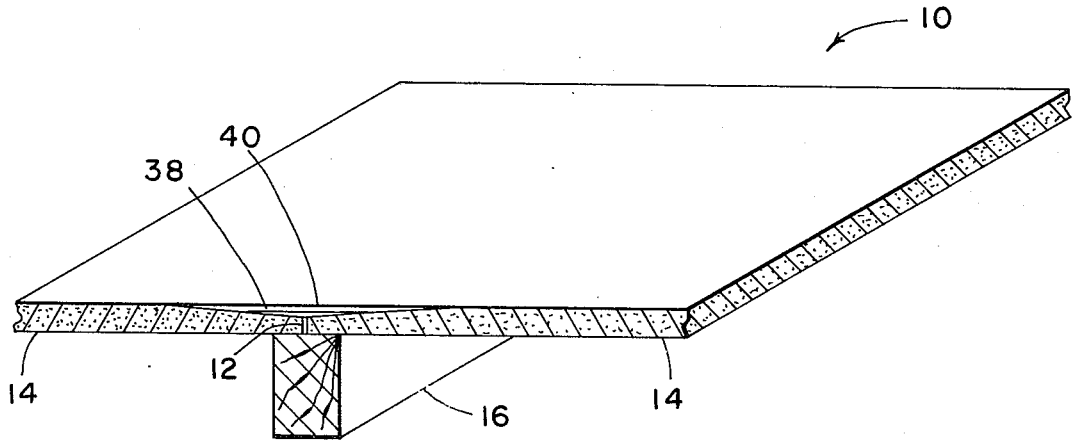
FIG. 3 is a view similar to FIG. 2, showing a second coat of joint compound applied.

After applying the coat of set accelerator 30, a first layer 36 of a joint compound having a calcined gypsum binder is applied, in a thickness of about 0.03 inch at the center tapered to a feathered edge at each side, covering an area centered over the joint about half the width of the two areas of taper 20. Immediately thereafter a second thin coat of set accelerator 30 is applied over all of the first layer 36 of joint compound, as shown in FIG. 2.

The joint compound of layer 36 is preferably formulated to provide a binder setting time of from about 1½ to 3 hours. This permits workers to mix batches of joint compound sufficient for an amount of joints which will take from about one to two hours to treat, which is a desirable size of batch for mixing and working with. The joint compound of layer 36 is caused to set in substantially less time than the 1½ to 3 hours above mentioned, because of the effect of the two coats of set accelerator applied respectively under and over layer 36.

After the calcined gypsum binder in layer 36 has set and layer 36 has hardened, a second layer 38 of a joint compound, preferably the same material as in layer 36, is applied, also in a thickness of about 0.03 inch, tapered to a feathered edge at each side. Second layer 38 fills the balance of the depression caused by the tapers 20, 20, producing a finished surface 40 flush with the surface of the main portions 24, 24 of the wallboards 14, 14. If desired, a third thin coat of set accelerator 30 may be applied over the second layer 38 of joint compound.

The composition of the joint compound to be accelerated in setting time by the set accelerator can be varied considerably in accordance with the invention so long as a primary binder material in the composition is calcined gypsum. Examples of such formulations are taught in Elden U.S. Pat. No. 3,303,147.

The set accelerator 30 is preferably $Al_2SO_4$, however any of several other accelerators have been found to provide the desired function although to a somewhat lesser degree. They include $CaSO_4$, $MgSO_4$, $K_2SO_4$, KAl $SO_4$, NaH $SO_4$, Zn $SO_4$, Cd $SO_4$, Cu $SO_4$, $Na_2SO_4$, Fe $SO_4$, Cr $SO_4$ $(NH_4)_2SO_4$, Zinc acetate, potassium bi chromate, ferric chloride, sulfuric acid, and oxalic acid.

In the preferred form, the $Al_2SO_4$ is sprayed as a 15% aqueous solution. Alternatively, the accelerator 30 could be brushed on or rolled on, in solution, or even spread on undiluted as a dry powder.

An additional source of set accelerator may be provided, if desired, by preparing the tape 22, prior to adhering to the joint 12, with a factory-applied, or otherwise pre-applied, coating of set accelerator 30. A paper tape, saturated with a set accelerator 30, can be substituted for the woven tape 22.

By the acceleration of the gypsum binder, after the joint compound is applied, a large quantity of joint compound slurry can be prepared for use during the following hour or two, and this same joint compound slurry, when applied over the thin coat of accelerator, and with a top thin coat of accelerator, sets rapidly, for example in about 15 minutes from the time it is applied. Consequently, the wall section can be moved and further assembled, minimizing the cost of factory fabrication of homes. Because of the relatively slow setting characteristic of the joint compound slurry, prior to application, the application can be carried out using machines for holding and applying the joint compound without the problem of the material hardening in the machine. Machines known in the trade as Ames tools are available for this purpose.

Having completed a detailed disclosure of the preferred embodiments of our invention so that those skilled in the art may practice the same, we contemplate that variations may be made without departing from the essence of the invention or the scope of the appended claims.

We claim:

1. The method of treating joints in drywall construction comprising the steps of saturating a narrow reinforcing tape with a set accelerator for settable gypsum, adhering said narrow reinforcing tape over a joint between a pair of wallboards, coating a narrow area of the face of said pair of wallboards along each side of said joint between the said wallboards with a set accelerator for settable gypsum with said coating covering said tape, applying a thin layer of a joint compound having a settable gypsum binder over the area of said coating of set accelerator, and applying a second coating of said set accelerator over the top of said thin layer of joint compound, whereby said thin layer of joint compound hardens rapidly and subsequently steps in the erection of a finished wall therefrom may proceed substantially sooner thereafter.

* * * * *